US008870671B1

(12) United States Patent
Foley

(10) Patent No.: US 8,870,671 B1
(45) Date of Patent: Oct. 28, 2014

(54) INTERACTIVE GOLF GAME WITH AUTOMATIC SCORING

(76) Inventor: Thomas P. Foley, Selbyville, DE (US)

( * ) Notice: Subject to any disclaimer, the term of this patent is extended or adjusted under 35 U.S.C. 154(b) by 1049 days.

(21) Appl. No.: 12/334,190

(22) Filed: Dec. 12, 2008

(51) Int. Cl.
*A63B 69/36* (2006.01)
*A63B 67/02* (2006.01)

(52) U.S. Cl.
USPC ..... 473/153; 473/176; 473/192; 473/222

(58) Field of Classification Search
USPC ..... 473/150–155, 192, 169, 221–225, 176
See application file for complete search history.

(56) References Cited

U.S. PATENT DOCUMENTS

| | | | | |
|---|---|---|---|---|
| 4,879,651 | A | 11/1989 | Little, Jr. | |
| 4,940,236 | A | 7/1990 | Allen | |
| 4,991,850 | A | 2/1991 | Wilhlem | |
| 5,056,106 | A | 10/1991 | Wang et al. | |
| 5,132,622 | A | 7/1992 | Valentino | |
| 5,354,052 | A | 10/1994 | Nicholls et al. | |
| 5,370,389 | A | 12/1994 | Reising | |
| 5,487,542 | A | 1/1996 | Foley | |
| 5,582,550 | A | 12/1996 | Foley | |
| 6,196,932 | B1 * | 3/2001 | Marsh et al. | 473/223 |
| 6,299,553 | B1 * | 10/2001 | Petuchowski et al. | 473/409 |
| 6,884,180 | B2 * | 4/2005 | Corzilius et al. | 473/351 |
| 6,974,391 | B2 * | 12/2005 | Ainsworth et al. | 473/153 |
| 7,040,998 | B2 * | 5/2006 | Jolliffe et al. | 473/151 |
| 2007/0167247 | A1 * | 7/2007 | Lindsay | 473/131 |

OTHER PUBLICATIONS

BPS™ Technology "Radargolf," Radar Corporation, 2817 Crow Canyon, Suite 203, San Ramon, CA 94583; http://www.radargolf.com/; (6 pages).

* cited by examiner

*Primary Examiner* — Mark Graham
(74) *Attorney, Agent, or Firm* — Blank Rome LLP

(57) ABSTRACT

A golf game system is provided, including at least one ball, at least one club and at least one hole area. The club has a striking sensor for sensing a striking action of the club on the ball, and a score display for displaying a score related to the striking action. The hole area has a tee for placing the ball and a hole for receiving the ball, wherein the hole has a ball-in-the-hole sensor for communicating with the club. Scores are automatically printed for players at game conclusion.

10 Claims, 6 Drawing Sheets

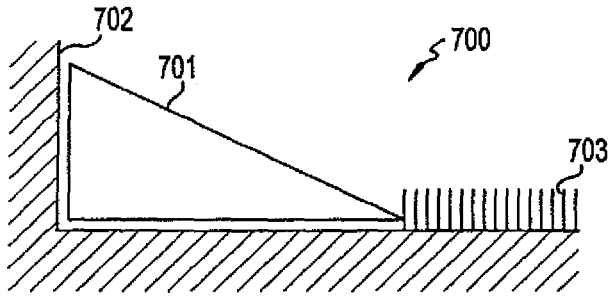
FIG. 7
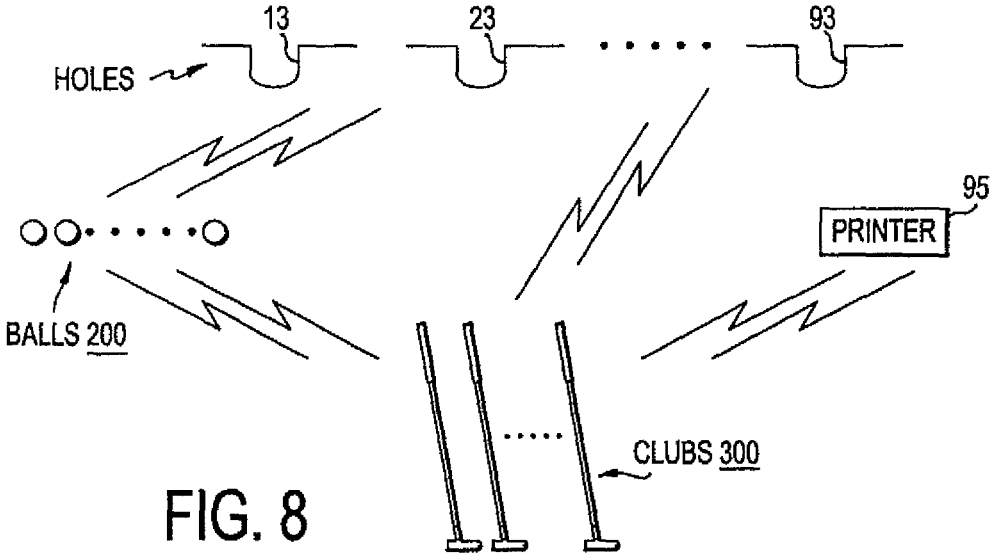
FIG. 8
| 1020 | 1010 | | 1030 |
|---|---|---|---|
| 1022 | 1012 | 1014 | 1032 |
| LEFT REGION | CENTRAL REGION | | RIGHT REGION |
FIG. 10

INTERACTIVE GOLF GAME WITH AUTOMATIC SCORING

REFERENCE TO RELATED APPLICATIONS

The present application is related to U.S. Pat. No. 5,487,542, filed Mar. 21, 1995 and issued on Jan. 30, 1996 and U.S. Pat. No. 5,582,550 filed Jan. 16, 1996 and issued on Dec. 10, 1996. The entire disclosures of the '542 and the '550 patents are incorporated herein by reference.

FIELD OF THE INVENTION

The present invention relates to a type of game that has at least one ball, one club, and one hole into which the ball may fall. More specifically, the present invention relates to an interactive golf game where a score is automatically displayed on the club, and printed when the game is completed.

BACKGROUND OF THE INVENTION

Mini golf has been a popular game for many years, with courses typically having 9 or 18 holes. Scoring is usually written manually by each player, which slows the game and sometimes bores the players. There is a need for an inexpensive system that can be readily added to existing mini golf courses, without rebuilding of the courses, which can automatically display the scores on the club to speed up the game and increase the player's enjoyment.

Several U.S. patents are concerned with the field of the invention, such as:

Nicholls et al, U.S. Pat. No. 5,354,052, shows a golf course hole-in-one detector.

McEvoy, U.S. Pat. No. 1,840,406, shows a mechanical stroke counter attached to a golf club. The counter is augmented when a ball is struck.

Reising, U.S. Pat. No. 5,370,389, discloses golf balls which include bar codes for identification of the individual balls. A computer 118 is connected to a plurality of sensors.

Valentino, U.S. Pat. No. 5,132,622, shows a golf ball having a metal center which is magnetically detectable.

Wang et al, U.S. Pat. No. 5,056,106, shows radio location of golf course positions using different radio frequencies.

Gordon, U.S. Pat. No. 3,891,221, shows a magnetic golf ball. The magnetic properties of the ball are not used for sensing.

Jetton, U.S. Pat. No. 3,104,879, shows cables running to a central computer from various golf holes having golf ball sensors.

Golf clubs with impact sensors are disclosed by Wilhelm, U.S. Pat. No. 4,991,850, and by Allen, U.S. Pat. No. 4,940,236. Both employ piezoelectric sensors in the golf club head to register impact against golf balls. The sensors do not appear to distinguish between impacts with golf balls and other objects.

Other U.S. Pat. Nos. are: U.S. Pat. No. 5,056,106 to Wang et al; U.S. Pat. No. 3,436,076 to Barthol; U.S. Pat. No. 3,868,692 to Woodward et al; U.S. Pat. No. 4,220,992 to Blood et al; U.S. Pat. No. 4,660,039 to Barricks et al; U.S. Pat. No. 4,879,651 to Little, Jr.; U.S. Pat. No. 4,940,236 to Allen; and U.S. Pat. No. 4,991,850 to Wilhelm.

The prior art does not disclose any device which allows automatic score-keeping interactive with game players, which can be readily added to existing courses at low additional cost.

SUMMARY OF THE INVENTION

Accordingly, the present invention has an object, among others, to overcome deficiencies in the prior art such as noted above.

A golf system is provided, including at least one ball, at least one club and at least one hole area. The ball contains a passive electronic device. The club has a striking sensor for sensing a striking action of the club on the ball, and a score display for displaying a score related to the striking action. The hole area has a tee for placing the ball and a hole for receiving the ball, wherein the hole has a ball-in-the-hole sensor for communicating with the club.

Another aspect of the invention is the detail of the club. The invention provides that the club has a shaft having a first end and a second end; a head attached to the first end of the shaft, the head having a striking sensor for sensing an action of the head striking the ball; and a handle attached to the second end of the shaft, having a score display for displaying a score related to the striking action of the head.

Yet another aspect of the invention is a method for displaying scores of a golf game. The method includes the steps of: providing at least one ball; providing at least one club having a striking sensor for communicating with the ball, and a score display for displaying a score related to a striking action by the club; providing at least one hole for receiving the ball; providing a ball-in-the-hole sensor in the hole; transmitting a ball-in-the-hole signal from the ball-in-the-hole sensor to the club when the hole receives the ball; and displaying a score on the score display upon receiving the ball-in-the-hole signal.

A further aspect of the invention is a method of automatically printing scores when the game is completed, by the club sensing the unique ball-in-the-hole signal from the final game hole, and downloading all stored scores to a printer which is instrumented to receive and print such scores.

BRIEF DESCRIPTION OF THE DRAWINGS

The above and other objects and the nature and advantages of the present invention will become more apparent from the following detailed description of preferred embodiments taken in conjunction with the drawings, in which:

FIG. 7 is a cross section of an exemplary bevel in a golf fairway;

FIG. 8 is a block diagram of the electrical communications in the golf game system of FIG. 1;

FIG. 10 is a drawing of a cross section of the tee area of FIG. 9.

DETAILED DESCRIPTION OF THE PREFERRED EMBODIMENTS

Figure 1:
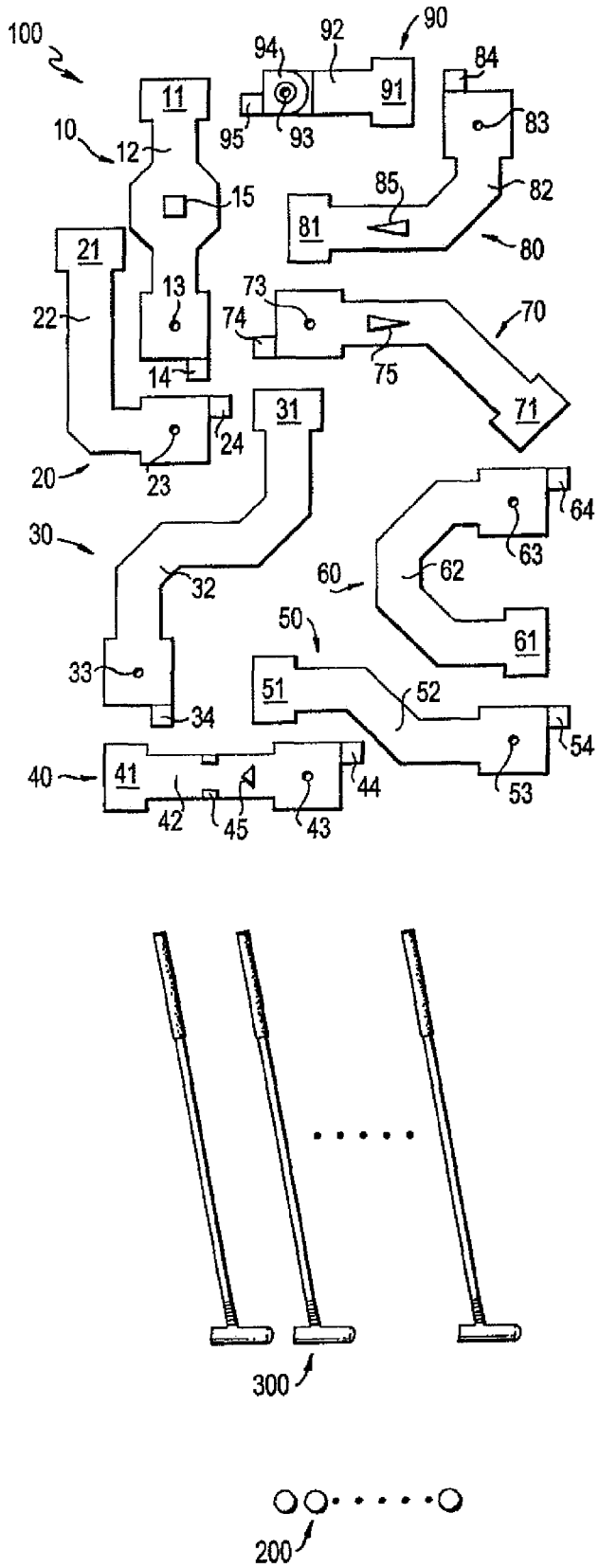
FIG. 1 is a plan view of a mini-golf course according to an exemplary embodiment of the present invention.

Preferred embodiments of the invention will be set forth in detail with reference to the drawings, in which like reference numerals refer to like elements or steps throughout.

The invention described in the drawing figures below relates to a mini golf game. The golf course has a plurality of holes. At the start of the game, an attendant supplies each player with a golf ball from a plurality of balls. Each of the balls has a passive radio-frequency identification (RFID) chip embedded therein to respond to golf clubs and holes. The identification number in each ball is different from the identification numbers of other balls. An example of a passive RFID chip of an appropriate size is produced by Texas Instruments, Inc., part number RI-I03-112A.

After receiving a golf ball, the player selects a golf club from a plurality of clubs available at the course. Each of the clubs may have a sensor to read the identification number of the ball to pair with the ball for the entire game. The club also contains an internal force sensor in the club's head, which senses the act of the club striking the ball, and transmits a low power RFID interrogation to the ball. A receiver in the club decodes the ball's response as a stroke and retains a memory of each stroke taken. The club also has a display to show the current stroke score.

Each of the golf holes is encoded with a digital identification code. Each golf hole has a golf cup to receive the ball. The golf hole also includes a force sensor and a low power RFID interrogator located at the bottom of the hole. When the ball falls into the golf hole, the force sensor triggers the low power RFID interrogator to read the response of the impact of the ball falling into the golf cup to determine the ball's identification and transmit the ball's identification code, along with the hole's identification code, to a receiver located in the club. The club then stores the number of strokes taken until it receives a ball-in-hole signal from the hole. The score is stored within the club's memory as the hole score for that hole. The club's memory then starts separately recording the score for the next hole.

The play of the game progresses in the manner described above by each player until all of the balls are retained in the final hole. When each club receives a ball-in-hole signal from the final hole, the club transmits the scores for each hole as well as the final score from its memory to a printer at the vicinity of the final hole. The printer then prints that player's hole-by-hole and total score for the player's retention. After transmitting all such recorded scores, the club clears its memory to be ready for use by a future player.

FIG. 1 shows a plan view of a mini golf course 100 according to an exemplary embodiment of the present invention. As shown in FIG. 1, the golf course 100 includes nine hole areas 10, 20, 30, 40, 50, 60, 70, 80 and 90 and a printer 95. Each of the areas 10, 20 30, 40, 50, 60, 70, 80 and 90 generally has a tee area, a fairway, and a hole. The golf game can accommodate a plurality of players, wherein each player strikes a golf ball with a club or putts from the tee area at one end of the fairway, into the hole at the other end of the fairway. Obstructions may be strategically placed in the fairways and the fairways themselves may have various shapes and slopes to provide different degrees of difficulty for the players.

Specifically, the first area 10 includes a tee area 11, a fairway 12 with an obstruction 15, and a hole 13. The second area 20 includes a tee area 21, a fairway 22, and a hole 23. The third area 30 includes a tee area 31, a fairway 32, and a hole 33. The fourth area 40 includes a tee area 41, a fairway 42 with obstructions 45, and a hole 43. The fifth area 50 includes a tee area 51, a fairway 52, and a hole 53. The sixth area 60 includes a tee area 61, a fairway 62, and a hole 63. The seventh area 70 includes a tee area 71, a fairway 72 with an obstruction 75, and a hole 73. The eighth area 80 includes a tee area 81, a fairway 82 with an obstruction 85, and a hole 83. The ninth area 90 includes a tee area 91, a fairway 92, and a hole 93. The ninth area 90 is the last area of the golf game, thus also includes a target 94 to collect the balls for later use and a printer 95 for printing score sheets. Similarly, an 18 hole course would have tee, fairway, and a hole, with a printer at the final hole area. Each of the balls 200 has a ball identification code different from other ball identification codes, and each of the holes has a hole identification code different from other hole identification codes. Clubs 300 are also shown.

Figure 2:
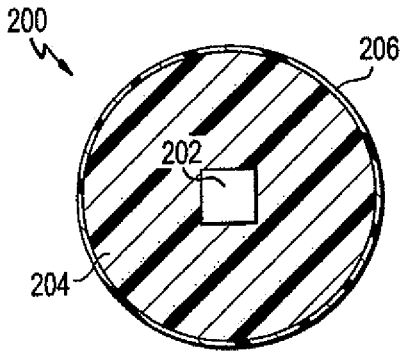
FIG. 2 is a drawing of a cross section of a golf ball according to an exemplary embodiment of the present invention.

Prior to playing, each player receives a golf ball 200, shown in FIG. 2. The ball 200 includes a passive RFID unit 201 with its unique digital identification code, or other electronic device capable of responding to an interrogator. The ball 200 is filled with material 202 transparent to radio waves and covered by a shell 203. In one example, each golf ball in a group playing together is painted a color different from other golf balls so that the players are able to differential their ball from other balls in the group.

Figure 3A:
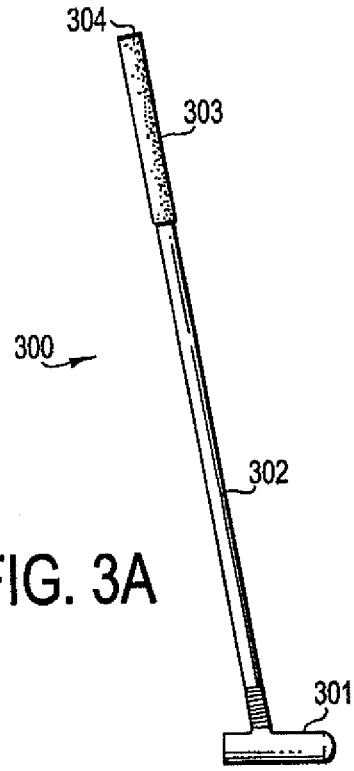
FIG. 3A is a profile view of a club according to an exemplary embodiment of the present invention.

FIG. 3A shows a profile of a club (or a putter) according to an exemplary embodiment of the present invention. The club 300 includes a head 301, a shaft 302, a handle 303, and a club-top display 304. One end of the shaft 302 is attached to the head 301 and the other end of the shaft 302 is attached to the handle 303. The club-top display 304 is at the end of the grip 303 to display the player's score. The player would hold the handle 303 and hit a golf ball with the head 301, and the display 304 displays the score. The head 301 has symmetrical striking surfaces to accommodate left or right-handed players.

Figure 3B:
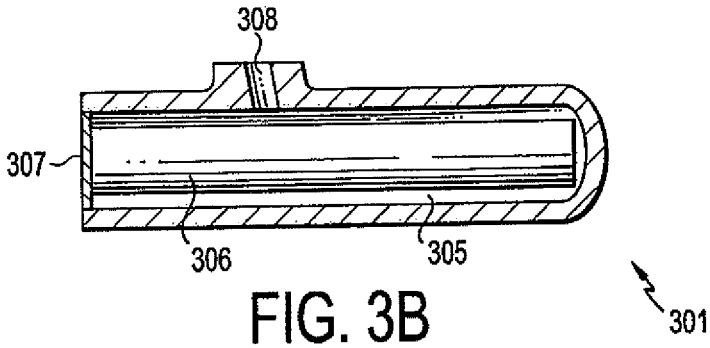
FIG. 3B is a drawing of a cross section of the head of the club shown in FIG. 3A.

FIG. 3B shows the internal construction of the head 301. Referring to FIG. 3B, the head 301 includes an outer shell forming a cavity 305 therein. The cavity 305 contains an electronic device 306 which includes a low power RFID interrogator and receiver to read the ball's unique digital code, a piezoelectric or other type of force sensor (not shown) to activate it when the head 301 impacts the ball. The head 301 also includes a removable plug 307 for allowing access to the electronic device 306 and a hole 308 for allowing wiring cables to connect with other components in the club.

Figure 3C:
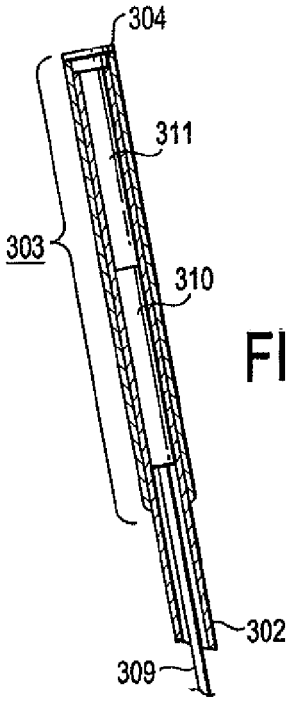
FIG. 3C is a drawing of the handle of the club shown in FIG. 3A.

FIG. 3C shows the club handle 303, including an electronics package 310 to activate the electronic device 306 in the head 301, communicate with the printer at the final hole, and count the number of strokes. The handle 303 also includes replaceable batteries 311, wiring cables 309 for connecting to the electronic device 306 in the head 301, and a club-top display 304 for displaying the player's scores. The display 304 is removable to allow access to replaceable batteries.

Figure 3D:
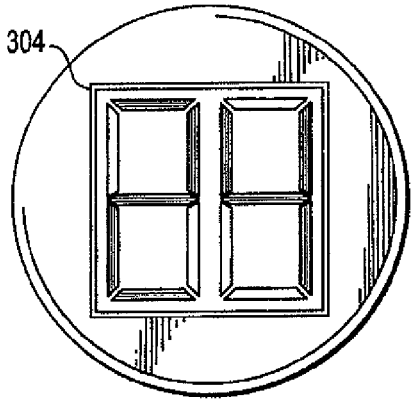
FIG. 3D is an exemplary score display on the top of the club.

FIG. 3D illustrates the club-top display 304. The display 304 shows a cumulative game score for the current game in progress. Even though the display 304 is shown to be at the end of the club, it could also be at another location on the club, such as on the side of the handle 303. Such displays are commercially available from several sources, such as the dual digit numeric LED displays (part number XZFMYK14A2) produced by SunLED Corporation.

Figure 4:
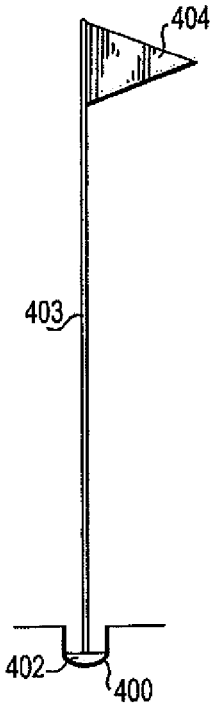
FIG. 4 is a drawing of a golf hole according to an exemplary embodiment of the present invention.

FIG. 4 shows a golf hole 400, which represents each of the golf holes 13, 23, 33, 43, 53, 63, 73, 83 and 93 of FIG. 1. The golf hole 400 includes a replaceable battery-driven electronic device 402, a pole having an antenna 403 and a flag 404. A portion of the electronic device 402 can be functionally identical with that in each club head 301, to allow the golf hole to sense the drop of a golf ball into the hole via a force sensor. The electronic device 402 also interrogates or detects the identification code of the ball, and communicates the ball's and the hole's identification codes to the club via an antenna 403.

Figure 5:
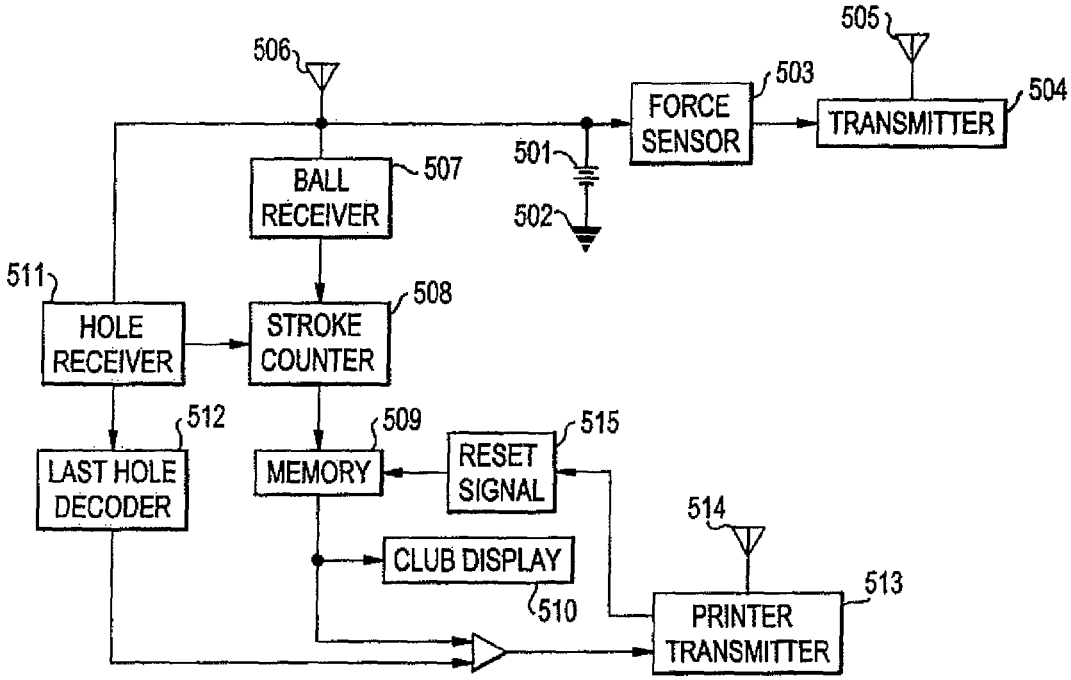
FIG. 5 is a diagram of an electronic device in a club according to another exemplary embodiment of the present invention.

FIG. 5 is a schematic block diagram of the electronic device in the club head and handle. The device 500 includes a battery 501, connected to a common ground 502, for supplying power to all components. When the force sensor 503 detects an impact with a golf ball, it energizes low-power transmitter 504 to transmit an interrogation signal through antenna 505. The passive RFID, or other electronic device, within the ball responds with its code through antenna 506 in the club head. Ball receiver 507 receives the response, compares the ball signal contained therein and, if the ball identity is correct, registers a stroke in stroke counter 508. To prevent transmissions from other balls affecting a club's score, the first stroke taken by each club in a round of play establishes the identity of the ball's code to be accepted by that club's ball receiver 507. Further strokes by the same club update the count in counter 508, and send the count to memory 509 as the hole score when a ball-in-hole signal is received from hole receiver 511.

When the ball falls into a hole, the hole receiver 511 reads the ball's identification code and sends the ball's and the hole's identification codes to the club through antenna 506. The counter 508 in the club, upon receiving the ball-in-the-hole signal from the hole, preserves the score of that hole in the memory 509. The aggregated sum of all hole scores in progress is sent by memory 509 to the club display 510 to display to the player. When a signal from the final hole is received by last hole decoder 512, the memory 509 is triggered to download all hole scores to printer transmitter 513 through the antenna 514 in the club. When the print transmission takes place, a reset signal 515 is sent to memory 509 to reset all memory to zero.

Figure 6:
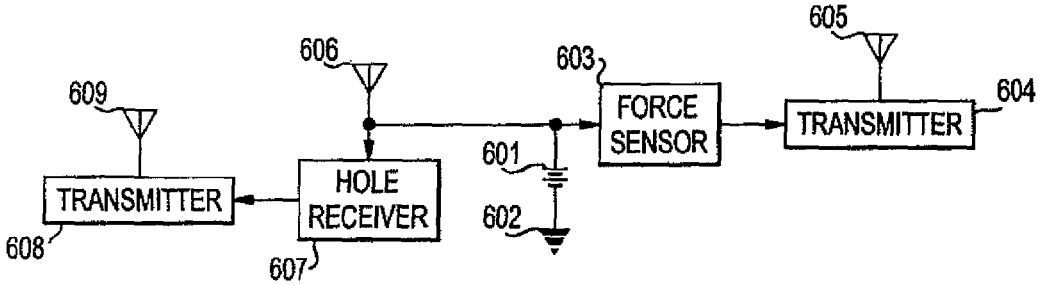
FIG. 6 is a diagram of an electronic device in a golf hole according to another exemplary embodiment of the present invention.

FIG. 6 is a schematic block diagram of the electronic device in each golf hole. Battery 601 provides power to all circuits through common ground 602. Force sensor 603 detects the fall of a ball into the hole, energizes the transmitter 604 to transmit an interrogation signal through the antenna 605 to the ball. The ball responds by transmitting a signal including the ball's identification code to the hole's receiver 607. The transmitter 608 in the hole then transmits both the hole's and the ball's codes through the antenna 609 to the player's club.

FIG. 7 shows a cross section of an exemplary fairway 700 and an exemplary bevel 701 that can be employed for the fairways 12, 22, 32, 42, 52, 62, 72, 82 and 92 of FIG. 1. Each of the fairways includes a green area (typically synthetic grass) and vertical sides on two sides of the green area to prevent the golf balls from falling out of the fairway. As shown in FIG. 7, the fairway 700 includes a synthetic-grass green area 703, a vertical side 702 and the bevel 701. The bevel 701 may be a strip of plastic or hard rubber, having a triangular shape in its cross section, and is selectively installed at the edge of a vertical side 702 and the green area 703 to prevent the golf balls from coming to rest against such vertical sides. It is common practice to use clubs to move the balls out several inches so that the balls can be putted properly. Such an action may cause a false stroke to be registered. The bevels such as the bevel 701 eliminate the need for moving the balls with a club.

FIG. 8 is a block diagram of the communications that transpire between components of the entire interactive golf game system with automatic scoring. Clubs 300, balls 200, holes 400 and printer 95 each transmit and respond as previously described. The reference numbers of the components in FIG. 8 are correspondent to those in FIG. 1. Golf balls 200 sense interrogations from clubs 300 and holes 400 and respond. Clubs 300 transmit scores to the printer 95.

Testing of the entire system can be accomplished by an attendant selecting a ball and club, playing through all the holes of the game to receive the printed score sheet, and then tapping each remaining club head with a ball to view a club handle score response. After viewing such score, the attendant will clear each club memory by using a portable device that transmits a "final hole" signal. Batteries, or entire devices, that fail to operate can be replaced from spares on hand. The testing procedure can be repeated at intervals during course operating hours. Several methods may be used to preserve battery energy and to identify low charge in each club and hole device. A timer may be included in club display 509 to limit the time the display is shown to only several seconds after a stroke is recorded. Each club device may also measure battery voltage, and contain a circuit to cause the display to show a low battery indication such as a "C" in the display, so the operator will be warned to replace batteries in the club during tests. Similarly, each hole device may measure battery voltage, and include in its transmission a code to allow the display to show a low battery indication such as an "H" in the club display, to warn the operator to replace hole device batteries. Furthermore, the letter "C" can be in the left digit of the club display and the letter "H" can be in the right digit of the club display.

Figure 9:
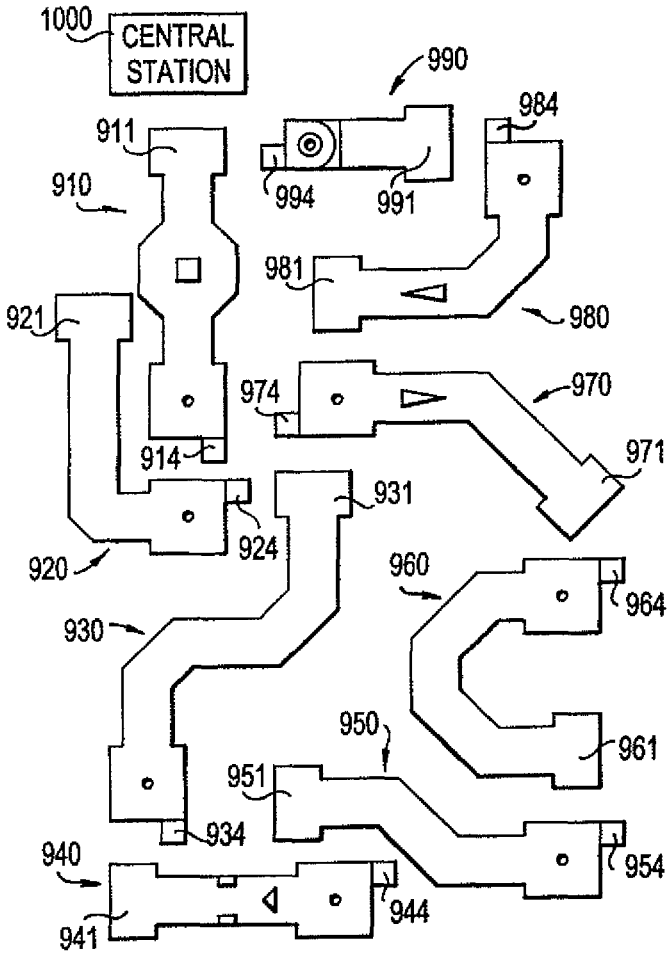
FIG. 9 is a plan view of a mini-golf course according to another exemplary embodiment of the present invention.

FIG. 9 shows a plan view of a mini golf course 900 according to another exemplary embodiment of the present invention. The golf course 900 is an expansion of the course 100 of FIG. 1, in that it further includes a central computer station 1000 and an electronic message board at each of the holes. Referring to FIG. 9, the golf course 900 includes nine hole areas 910, 920, 930, 940, 950, 960, 970, 980 and 990 and the central station 1000. The central station 1000 includes a computer for receiving names of the players, a receiver for receiving signals, and a transmitter for transmitting signals. The names of the players can be entered by a keyboard or touchscreen. As the computer signals a dispenser to issue a golf ball to each of the players, the identification codes of each of the dispensed balls will be read into the computer of the central station 1000 such that the computer can link the names of the players to their respective golf balls. The balls may have the same structure as that in FIG. 2. Each of the players selects a club. Each of the club may have the same structure as the club shown in FIGS. 3A-3D.

As shown in FIG. 9, each of the hole areas 910, 920, 930, 940, 950, 960, 970, 980 and 990 includes a tee, a fairway, and a hole. Each of the hole areas further includes an electronic message board located near the hole. The message boards in FIG. 9 are labeled 914, 924, 934, 944, 954, 964, 974, 984 and 994. The message boards can be either LED for outdoor courses or plasma/LCD for indoor courses. The message boards receive signals from the computer of the central station 1000 to display the names of the players and interactive statements to encourage player's enjoyment.

In FIG. 9, the tee areas are labeled 911, 921, 931, 941, 951, 961, 971, 981 and 991 for the respective hole areas. Each of the tee areas has a tee sensor for sensing the presence of the players. FIG. 10 shows a cross-sectional view of an exemplary tee for the tees in FIG. 9. As shown in FIG. 10, the tee includes a central region 1010 for placing the golf balls, a left region 1020 and a right region 1030 for the players to stand on. Under the central region 1010 is an interrogator 1012 for reading the identification code of the ball placed on the tee and a transmitter 1014 for communicating with the central station 1000 of FIG. 9. Under the left region 1020 is a first tee force sensor 1022 and under the right region 1030 is a second tee force sensor 1032. Any types of force sensors, interrogators, and transmitters available in the market can be used for the force sensors, interrogators, and transmitters in the tees. In operation, as a player places a ball on the tee in the central region 1010 and stands on the left region 1020 (or right region 1030), the first force sensor 1022 (or the second force sensor 1032) senses the weight of the player, which causes the interrogator 1012 in the central region 1010 to read the ball's identification code. The transmitter 1014 in the central tee region 1010 then sends the ball's identification code to the central station 1000 to signify that the player is about to play in this hole area. A transmitter at the central station 1000 then sends a signal to the message board of the hole to display a message for that player whose name is linked to the ball's code.

Referring again to FIG. 9, as indicated above, each of the golf holes areas 910, 920, 930, 940, 950, 960, 970, 980 has a hole. Each hole has a structure similar to that in FIG. 4. The hole includes a flag pole, a cup for receiving the ball, and a ball-in-the-hole sensor. The ball-in-the-hole sensor for the holes in the golf course 900 sends a signal to the central station 1000 such that the central station will keep track of the progress of the game.

After the central station 1000 receives the ball-in-the-hole signals for each of the golf balls, a score sheet is printed, giving the hole-by-hole and final score for each of the players.

The expansion described in FIG. 9 can be added at any later time to the interactive golf game with automatic scoring described in FIG. 1, without major course rebuilding, to increase player enjoyment.

While preferred embodiments of the invention have been set forth above, those skilled in the art who have reviewed the present disclosure will readily appreciate that other embodiments or terminology can be realized within the scope of the invention. For example, although the invention described above is for mini-golf, the invention also work for a regular golf game, cricket, or any game with balls, clubs to strike the balls, and holes into which the balls may fall. Therefore, the present invention should be construed as limited only by the appended claims.

I claim:

1. A game system, comprising:

at least one ball, said at least one ball comprising a passive electronic identification unit storing a ball identification code identifying said at least one ball;

at least one club comprising a striking sensor for sensing a striking action of the at least one club on the at least one ball, an electronic interrogator for interrogating the passive electronic identification unit to retrieve the ball identification code, and a score display for displaying a score related to the striking action; and at least one hole area comprising:

a tee for placing the at least one ball, and a hole for receiving the at least one ball, the hole having a ball-in-the-hole sensor for communicating with the at least one club;

wherein the at least one ball comprises a plurality of balls, each of the balls having a ball identification code different from other ball identification codes;

wherein the at least one club comprises a plurality of clubs;

wherein the at least one hole area comprises a plurality of hole areas, the hole in each of the hole areas having a hole identification code different from the hole identification codes of other holes; and wherein each of the plurality of clubs is configured to read the ball identification code of one of the plurality of balls to pair with said one of the plurality of balls for an entirety of a game.

2. The game system of claim 1, wherein the at least one club comprises:

a shaft having a first end and a second end;

ahead attached to the first end of the shaft, the head having the striking sensor and the electronic interrogator; and a handle attached to the second end of the shaft, the handle having the score display.

3. The game system of claim 1, wherein the at least one hole area includes a plurality of hole areas;

wherein the at least one club further comprises a memory for storing scores of each of the hole areas and an aggregated score of a game.

4. The game system of claim 1, further comprising a printing device in communication with the at least one club for printing a final game score.

5. The game system of claim 1, wherein the at least one hole area includes at least nine hole areas, each of the hole areas further comprising:

a fairway located between the tee and the hole, the fairway having vertical sides and a plurality of bevels selectively attached to the vertical sides to prevent the at least one ball from resting against the vertical sides.

6. The game system of claim 1, further comprising a central station having a computer for receiving a name of at least one player and relating the player's name to the at least one ball received by the player.

7. The game system of claim 6, further comprising at least one message board located near the hole of the at least one hole area, for communicating with the central station and displaying messages to each player.

8. The game system of claim 7, wherein the tee of the at least one hole area comprises a tee sensor for communicating with the central station.

9. The game system of claim 8, wherein the tee sensor is configured to interrogate the passive electronic identification unit to retrieve the ball identification code.

10. A game system comprising:

at least one ball, said at least one ball comprising a passive electronic identification unit storing a ball identification code identifying said at least one ball;

at least one club comprising a striking sensor for sensing a striking action of the at least one club on the at least one ball, an electronic interrogator for interrogating the passive electronic identification unit to retrieve the ball identification code, and a score display for displaying a score related to the striking action; and at least one hole area comprising:

a tee for placing the at least one ball, and a hole for receiving the at least one ball, the hole having a ball-in-the-hole sensor for communicating with the at least one club; wherein when the at least one ball falls into the hole, the ball-in-the-hole sensor is adapted to interrogate the passive electronic identification unit to read the ball identification code and send a signal to the at least one club to identify the at least one ball and the hole.

* * * * *